US012504244B2

(12) United States Patent
Patel

(10) Patent No.: US 12,504,244 B2
(45) Date of Patent: Dec. 23, 2025

(54) MODULAR BOLT ACTION RIFLE WITH BEARINGS

(71) Applicant: DEFENSE RESEARCH AND DEVELOPMENT, LLC, Dallas, GA (US)

(72) Inventor: Swetal K. Patel, Dallas, GA (US)

(73) Assignee: Defense Research and Development, LLC, Dallas, GA (US)

( * ) Notice: Subject to any disclaimer, the term of this patent is extended or adjusted under 35 U.S.C. 154(b) by 0 days.

(21) Appl. No.: 18/893,824

(22) Filed: Sep. 23, 2024

(65) Prior Publication Data

US 2025/0102250 A1 Mar. 27, 2025

Related U.S. Application Data

(60) Provisional application No. 63/584,635, filed on Sep. 22, 2023.

(51) Int. Cl.
*F41A 3/66* (2006.01)
*F41A 3/26* (2006.01)

(52) U.S. Cl.
CPC . *F41A 3/66* (2013.01); *F41A 3/26* (2013.01)

(58) Field of Classification Search
CPC ..... F41A 3/12; F41A 3/18; F41A 3/22; F41A 3/44; F41A 3/48; F41A 3/20
See application file for complete search history.

(56) References Cited

U.S. PATENT DOCUMENTS 3,636,648 A * 1/1972 Spencer ..... F41A 19/13 42/16
9,354,005 B1 * 5/2016 Russo ..... F41A 5/20
9,791,224 B1 * 10/2017 Russo ..... F41A 3/12

* cited by examiner

*Primary Examiner* — Reginald S Tillman, Jr.
(74) *Attorney, Agent, or Firm* — Perilla Knox & Hildebrandt LLP; Kenneth A. Knox

(57) ABSTRACT

The present disclosure presents a modular bolt action rifle system with roller bearings having an upper receiver assembly housing a barrel, a lower receiver assembly comprising an AR-style fire control system and a magazine well, a bolt carrier group assembly including a bolt carrier, top roller bearings and side roller bearings, and a handguard assembly, wherein the lower receiver assembly and its AR-style fire control and magazine well are releasably attached to the upper receiver, and prior to attachment of the barrel assembly the bolt carrier group assembly, consisting of the bolt carrier, bolt head, bolt charging handle, top roller bearings, and side roller bearings is inserted unto the upper receiver. An extension of the barrel assembly is releasably attached to the upper receiver. The barrel assembly is releasably secured by releasable attachment of the handguard assembly to a barrel extension receiver of the upper receiver assembly.

20 Claims, 9 Drawing Sheets

MODULAR BOLT ACTION RIFLE WITH BEARINGS

CROSS-REFERENCE TO RELATED APPLICATION

This application claims the benefit of and priority to U.S. Provisional Patent Application No. 63/584,635 filed Sep. 22, 2023, the contents of which being incorporated by reference in their entirety herein.

BACKGROUND

A rifle is a type of weapon that fires rounds. Typically, the rifle includes a trigger, a hammer, and a barrel. The round is positioned in the barrel, and, when the trigger is pulled, the hammer fires the round through the barrel.

A bolt action rifle is loaded by a manually operated bolt. The rifle bolt is operated manually by using a bolt handle to open and close the breech. The breech is opened by rotating the bolt handle to unlock the bolt from the receiver and pulling it rearward to open the breech. Opening the breech provides for the extraction and ejection of a spent cartridge case, cocks the firing pin, and draws a new cartridged round from the magazine and into the breech. The bolt is closed by rotating the bolt handle to the original closed position to make the rifle ready to fire again.

The M1903 Springfield rifle is a type of conventional bolt-action rifle used primarily during the first half of the $20^{th}$ century. The Remington M-700 rifle is another type of conventional bolt-action rifle commonly used by civilians for hunting and by military and civilian law-enforcement agencies as sniper rifles.

A modular rifle typically includes a lower receiver assembly, an upper receiver assembly housing the barrel, and one or more coupling mechanisms. The M-16 style rifle is a type of modular rifle system commonly used by military and police forces that features a gas-operated bolt and bolt carrier system, as disclosed, for example, in U.S. Pat. No. 2,951,424, issued to Eugene M. Stoner on Sep. 6, 1960 (incorporated herein by reference in its entirety). The AR-15 style rifle is a similarly designed modular rifle system commonly sold and used in civilian applications.

Systems and methods for modular rifles and for quick take-down barrel systems and methods are disclosed in U.S. Pat. Nos. 7,810,271, 8,661,963, 8,689,478, and 8,739,449 issued to Swetal K. Patel and are incorporated herein by reference.

A system and method for a bolt action rifle that uses an AR-15 style fire control system and a modular design with roller bearings on the bolt provides for a rifle system that allows for a reduced friction for the bolt carrier and therefore less mechanical wear, reduced size of the bolt carrier group, and increased performance and reliability, particularly with powerful .50 BMG cartridges, and that allows for and take-down, or disassembly, of the rifle in an expeditious manner in the field and without requiring the use of multiple tools.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
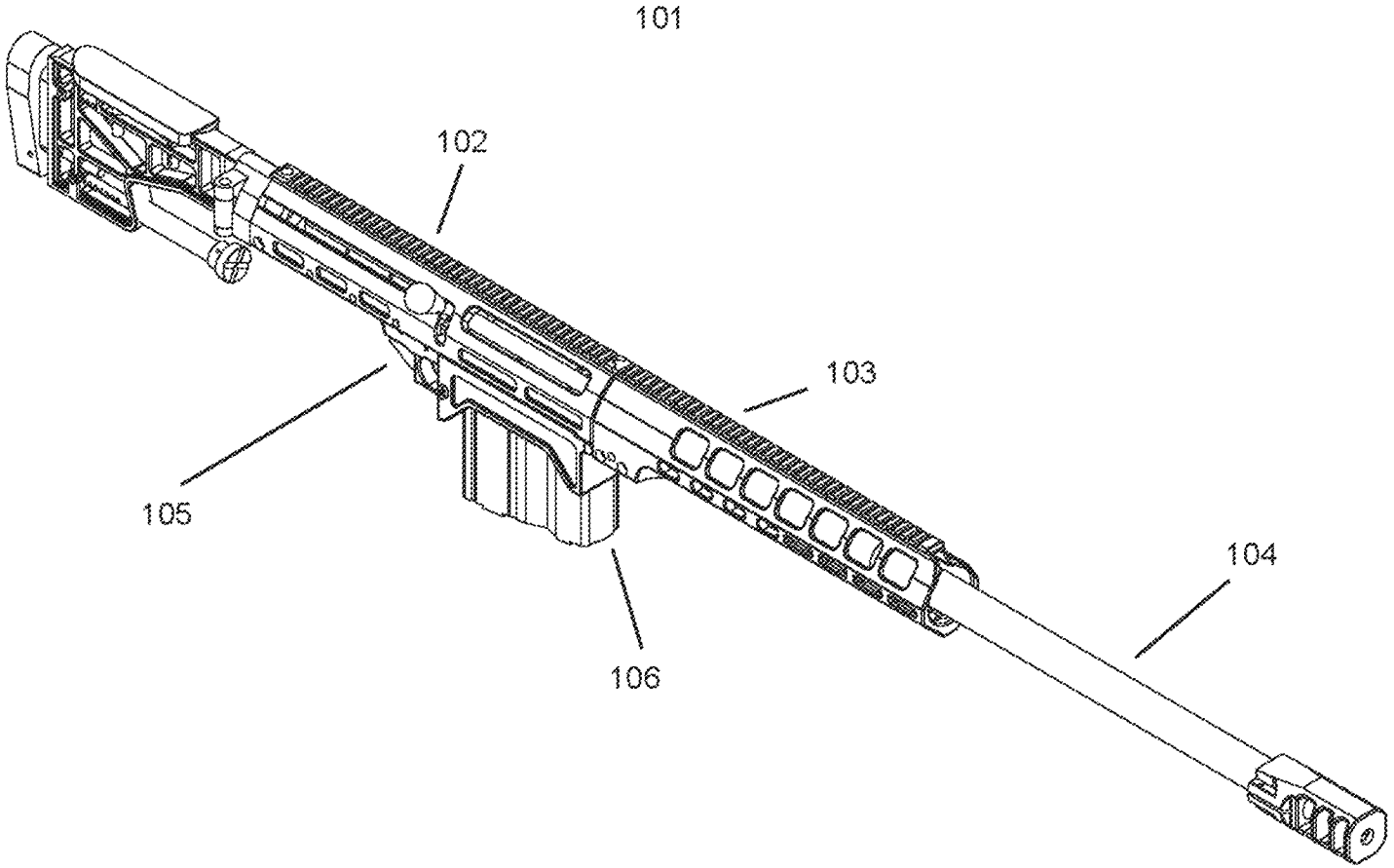
FIG. 1 is a perspective view of the assembled modular bolt action rifle system with bearings, showing the upper receiver assembly, lower receiver assembly including the fire control assembly and magazine well with magazine attached, barrel assembly, handguard assembly, and stock assembled in accordance with one exemplary embodiment of the present invention.
Figure 2:
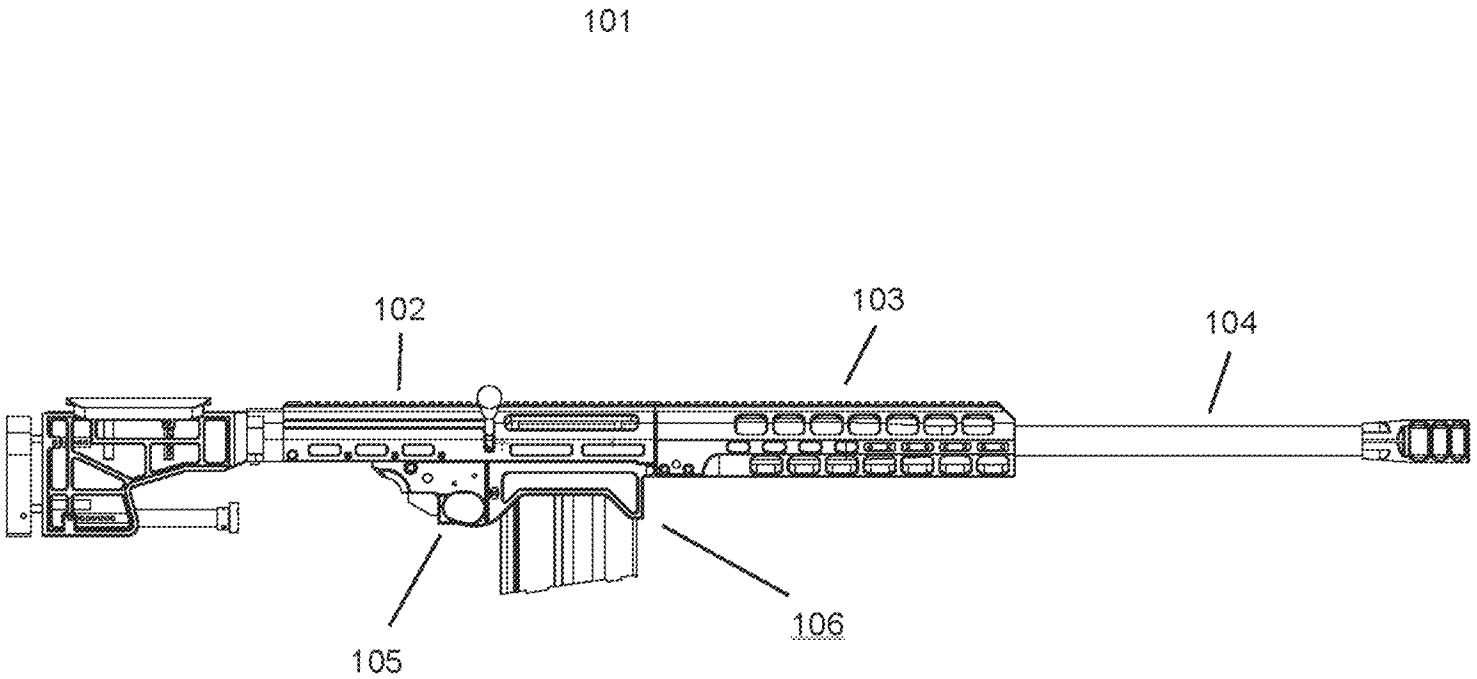
FIG. 2 is a side perspective view of the assembled modular bolt action rifle system with bearings, showing the upper receiver assembly, lower receiver assembly including fire control assembly and magazine well with magazine attached, barrel assembly, handguard assembly, and stock assembled in accordance with one exemplary embodiment of the present invention.
Figure 3:
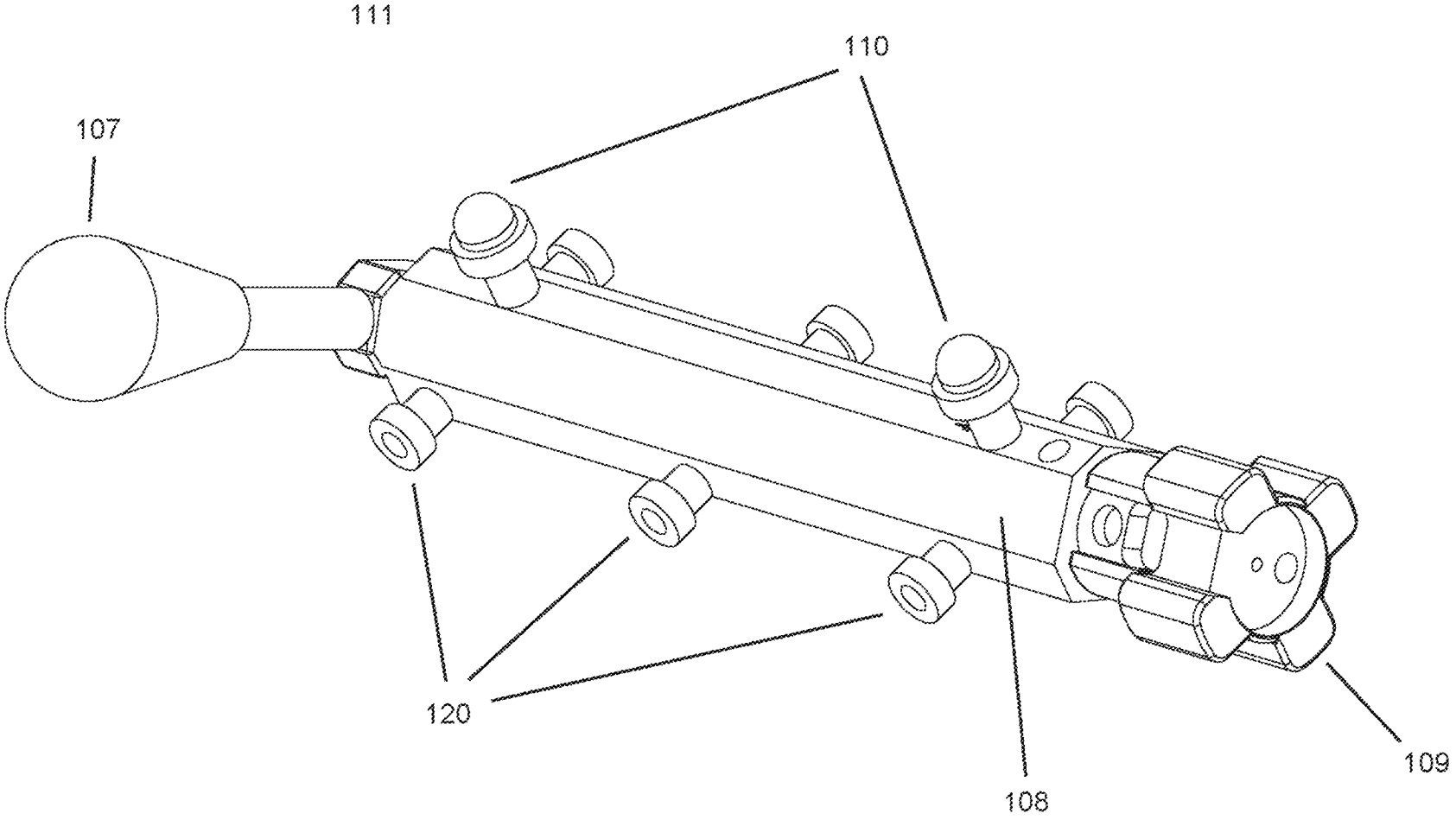
FIG. 3 is a perspective view of the assembled bolt carrier group assembly, showing the bolt head, bolt carrier, bolt charging handle, side roller bearings, and top roller bearings, assembled in accordance with one exemplary embodiment of the present invention.
Figure 4:
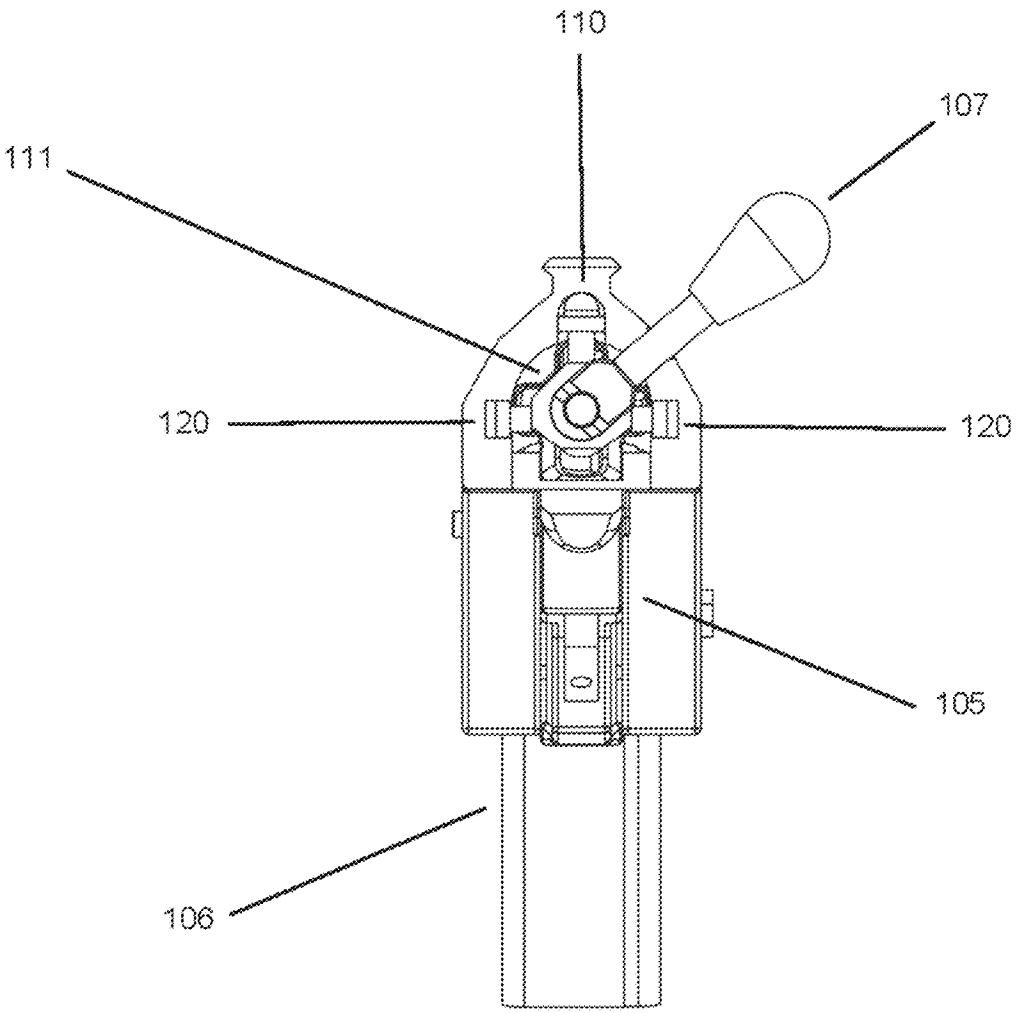
FIG. 4 is a rear perspective view of the of the assembled bolt carrier group assembly, showing the bolt head, bolt carrier, bolt charging handle, side roller bearings, and top roller bearings, the upper receiver assembly, the lower receiver assembly including the fire control assembly and the magazine well with magazine attached, assembled in accordance with one exemplary embodiment of the present invention.
Figure 5:
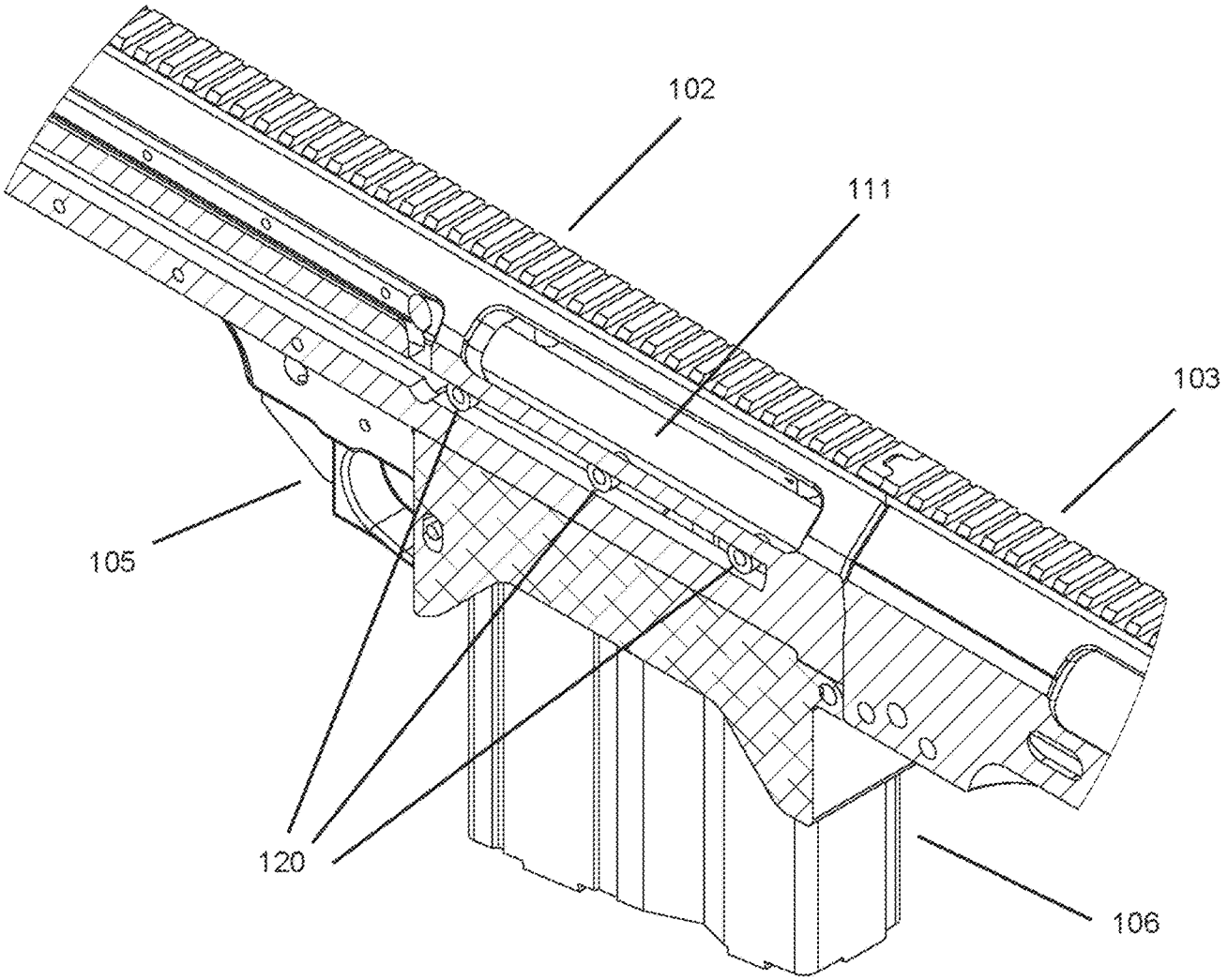
FIG. 5 is perspective cutaway view of the upper receiver assembly assembled to the handguard assembly, the lower receiver assembly including the fire control assembly and the magazine well with magazine attached, and bolt carrier group assembly, showing the side roller bearings as affixed to the bolt carrier inside the upper receiver.
Figure 6:
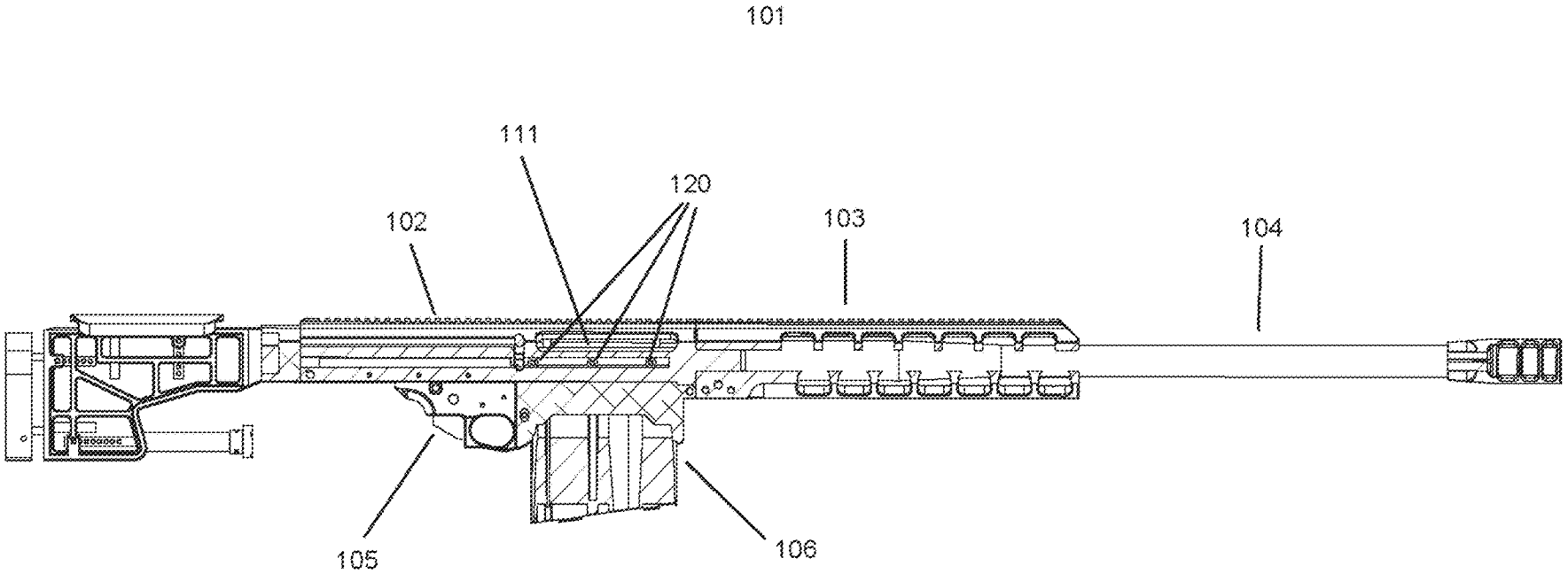
FIG. 6 is a side perspective cutaway view of the assembled modular bolt-action rifle system with bearings, showing the bolt carrier assembly within the upper receiver and three of the side roller bearings on one side of the bolt carrier, with the barrel assembly and the lower receiver assembly, including the fire control assembly and the magazine well with magazine attached, assembled to the upper receiver, and the handguard assembly assembled to the barrel assembly and upper receiver.
Figure 7:
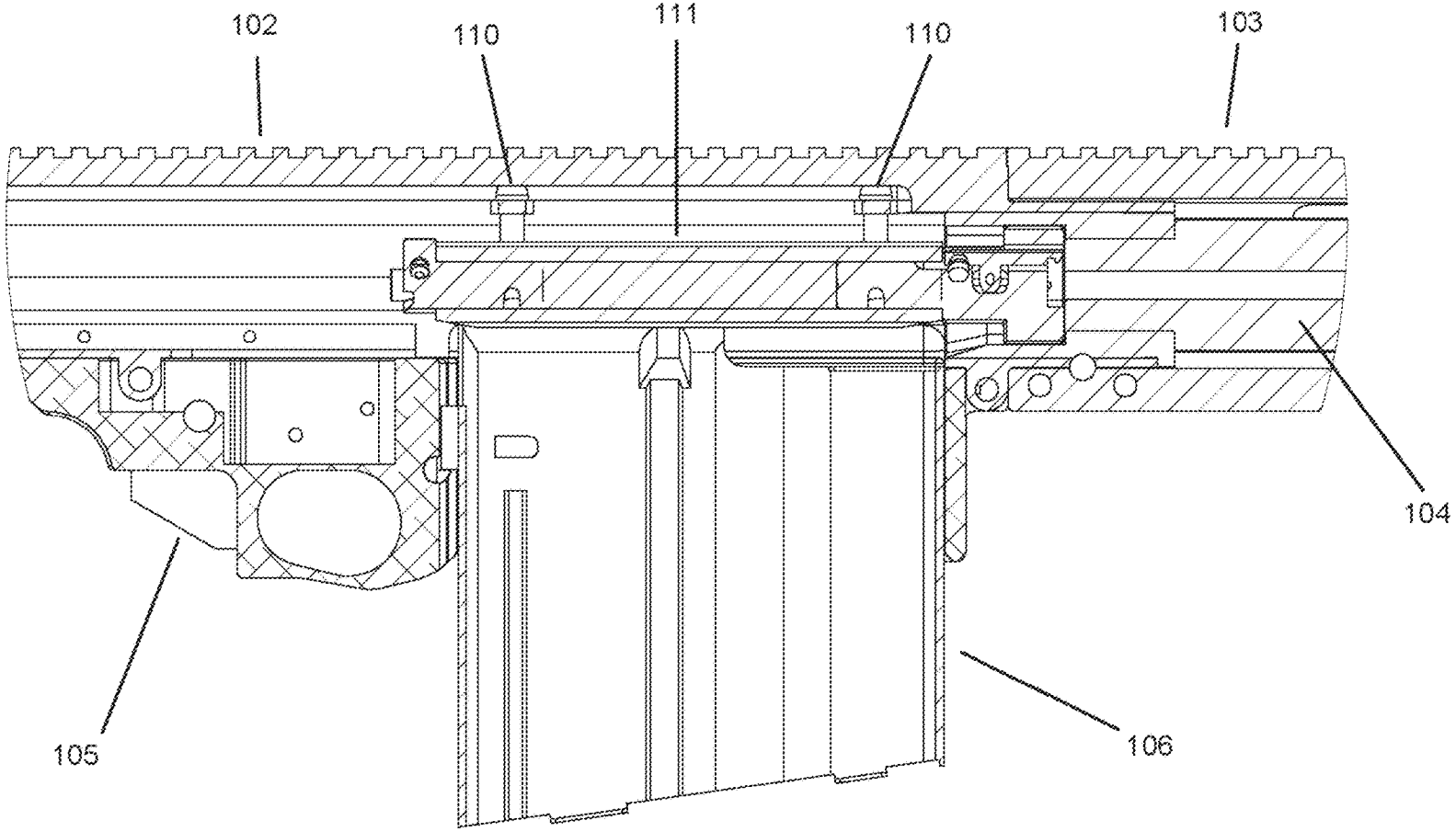
FIG. 7 is a side perspective cutaway view of the assembled modular bolt-action rifle system with bearings, showing the bolt carrier assembly within the upper receiver and two top roller bearings on top of the bolt carrier and within the bolt of the upper receiver, with the barrel assembly, and the lower receiver assembly including the fire control assembly and the magazine well with magazine attached assembled to the upper receiver and the handguard assembly assembled to the barrel assembly and upper receiver.
Figure 8:
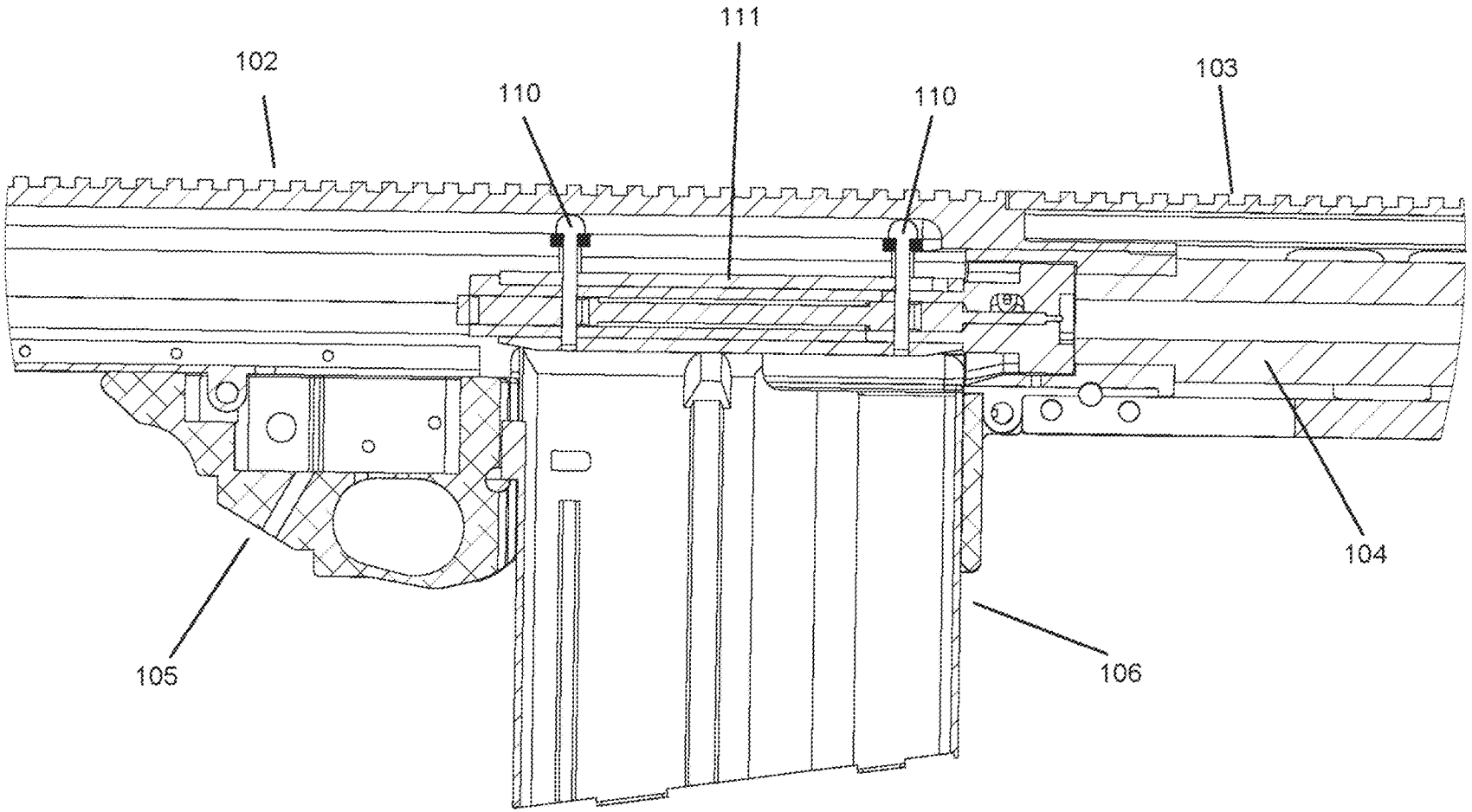
FIG. 8 is an additional side perspective deeper cutaway view of FIG. 7 of the assembled modular bolt-action rifle system with bearings, showing the bolt carrier assembly within the upper receiver and two top roller bearings on top of the bolt carrier and within the bolt of the upper receiver, with the barrel assembly and the lower receiver assembly, including the fire control assembly and the magazine well with magazine attached, assembled to the upper receiver, and the handguard assembly assembled to the barrel assembly and upper receiver.
Figure 9:
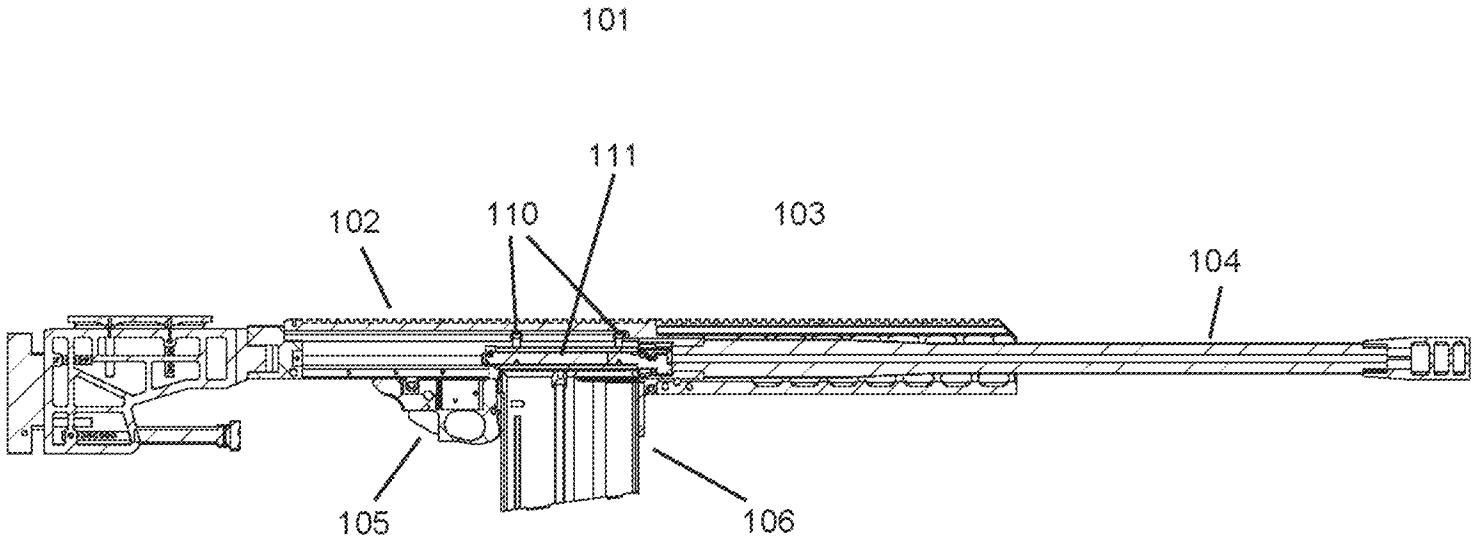
FIG. 9 is a side perspective cutaway view of the assembled modular bolt-action rifle system with bearings, showing the bolt carrier assembly within the upper receiver and two top roller bearings on top of the bolt carrier and within the upper receiver, with the barrel assembly, the lower receiver assembly including the fire control assembly and the magazine well with magazine attached assembled to the upper receiver, and the handguard assembly assembled to the barrel assembly and upper receiver.

According to one exemplary embodiment of the modular bolt action rifle system with bearings, the system 101 includes an upper receiver assembly 102 housing a barrel 104, a lower receiver assembly comprising an AR-style fire control system 105 and a magazine well 106, a bolt carrier group assembly 111 including bolt carrier 108, and a handguard assembly 103. Optionally, the system may include a stock or grip. The lower receiver comprising the AR-style fire control 105 and magazine well is releasably attached to the upper receiver 102 using conventional AR retaining pins. Prior to attachment of the barrel assembly, the bolt carrier group assembly 111, consisting of a bolt carrier 108, bolt head 109, bolt charging handle 107, top roller bearings 110, and side roller bearings 120, is inserted into the upper receiver 102. An extension of the barrel assembly 104 is releasably attached to the upper receiver 102 to a barrel extension receiver. The barrel assembly 104 is releasably secured by releasable attachment of the handguard assembly 103 to the barrel extension receiver of the upper receiver assembly 102 and the handguard assembly by insertion of one or more screws into screw receptacles which, when the screws are tightened, both compress the handguard assembly 103 to the barrel extension receiver and secure the handguard assembly 103 to the barrel extension receiver and upper receiver assembly 102 by engaging one or more channels in the barrel extension receiver.

In certain embodiments, a modular bolt action rifle system with bearings includes an upper receiver assembly housing a barrel assembly, a lower receiver assembly comprising an AR-style fire control system and a magazine well, a bolt carrier group assembly including bolt carrier with top roller bearings and side roller bearings, and a handguard assembly. The lower receiver assembly comprising the AR-style fire control is releasably attached to the upper receiver using conventional AR retaining pins. The barrel assembly is releasably attached to the upper receiver to a barrel receiver extension. The barrel assembly is releasably secured by releasable attachment of the handguard assembly to a barrel receiver extension of the upper receiver assembly by insertion of one or more screws which, when tightened, both compress the rail assembly to both the barrel receiver extension and secure the rail assembly to the barrel receiver extension and upper receiver assembly and engaging a releasable pin though the handguard and a channel in the barrel receiver extension.

While particular embodiments of modular bolt action rifles with bearings have been disclosed in detail in the foregoing description and figures for purposes of example, those skilled in the art will understand that variations and modifications may be made without departing from the scope of the disclosure. All such variations and modifications are intended to be included within the scope of the present disclosure.

In certain embodiments, this new system and method utilizes a traditional four-lug bolt head, bolt receiver, and firing pin, but has a bolt carrier that rides in its entirety on roller bearings such that the body of the bolt carrier never touches the interior of the upper receiver.

In certain embodiments, the roller bearings consist of two or more roller bearings on the top, or 12 o'clock position relative to the bolt carrier, and three or more side roller bearings on each side, or 3 o'clock and 9 o'clock positions, respectively, relative to the bolt carrier.

In certain embodiments, this new system and method allows for quick assembly and disassembly of a bolt action modular-style rifle system with bearings using an AR-style fire control system on a lower receiver assembly, joined to an upper receiver assembly with standard AR-style retaining pins, a barrel assembly, and handguard assembly, and an optional stock assembly.

In certain embodiments, a modular bolt action rifle with bearings provides for the mounting of the barrel assembly to the upper receiver to a barrel receiver extension and attaching the handguard or rail assembly to the barrel extension and the upper receiver with one or more screws which, when tightened, both compress the rail assembly to both the barrel receiver extension, and one or more releasable pins which and secure the handguard or rail assembly to the barrel receiver extension of the upper receiver assembly by engaging a receiving channel in the handguard and one or more channels in the barrel receiver extension.

In certain embodiments, to keep the handguard from rotating off the barrel receiver extension upper receiver assembly during firing of the rifle, the handguard portion is attached to the barrel receiver extension and one or more shoulder screws that compress the open machined slot at the 6 o'clock position on the hand guard portion.

In certain embodiments, one or more channels is machined in the outside diameter of the barrel receiver extension of the upper receiver assembly through which releasable pin is inserted, further keeping the hand guard portion from traveling forward along the barrel toward the muzzle during firing of the rifle. The handguard assembly is secured to the barrel assembly by one or more screws that, when tightened, compress the handguard to the barrel assembly. In this manner, the barrel assembly remains properly and securely attached to the upper receiver assembly of the rifle system.

In certain embodiments, the modular bolt action rifle system with bearings is chambered to fire .50 caliber, or .50 BMG, rounds.

In certain embodiments, the modular bolt action rifle system with bearings utilizes one-half inch roller bearings for the top roller bearings and 10 mm roller bearings for the side roller bearings.

It should be emphasized that the above-described embodiments of the present invention, particularly, any "preferred" embodiments, are merely possible examples of implementations, merely set forth for a clear understanding of the principles of the invention. Other systems, devices, methods, features, and advantages of the disclosed system and method include variations and modifications apparent or that may become apparent to one of skill in the art upon examination of the following figures and detailed description, without departing substantially from the spirit and principles of the invention. All such modifications and variations are intended to be included within this description.

Therefore, the following is claimed:

1. A modular bolt-action rifle system, comprising:

an upper receiver assembly comprising a bolt and a bolt carrier group assembly;

wherein the bolt carrier group assembly comprises:

a bolt head, a bolt carrier, side roller bearings fastened to each of side of the bolt carrier;

top roller bearings fastened to the top of the bolt carrier; and a bolt charging handle, a lower receiver assembly comprising:

a fire control system; and a magazine well;

a barrel assembly; and a handguard assembly; and wherein the load of the bolt carrier within the upper receiver is supported by the side roller bearings, and the bolt carrier moves within the upper receiver along a longitudinal axis of the rifle guided by the side and top roller bearings and without contact by the bolt carrier with the interior of the upper receiver.

2. The modular bolt-action rifle system of claim 1, wherein the fire control system is an AR-style fire control system.

3. The modular bolt-action rifle system of claim 1, wherein the upper receiver assembly is releasably attached to lower receiver assembly.

4. The modular bolt-action rifle system of claim 3, wherein the lower receiver assembly is releasably attached to the upper receiver assembly using retaining pins.

5. The modular bolt-action rifle system of claim 1, wherein the barrel assembly is releasably attached to the upper receiver assembly.

6. The modular bolt-action rifle system of claim 5, wherein the handguard assembly is releasably attached to the upper receiver assembly and the barrel assembly.

7. The modular bolt-action rifle system of claim 6, wherein the handguard assembly is releasably attached to the barrel assembly with screws which, when tightened, compress the handguard assembly to the barrel receiver extension, and wherein the handguard assembly is secured to both the barrel receiver extension of the upper receiver assembly and the barrel assembly by engaging one or more channels in the barrel receiver extension with one or more releasable pins.

8. The modular bolt-action rifle system of claim 7, wherein the handguard assembly comprises an open machined slot at the 6 o'clock position and is attached to the barrel receiver extension such that one or more the screws compress the handguard assembly at the 6 o'clock position and secure the handguard assembly to the barrel assembly.

9. The modular bolt-action rifle system of claim 1, wherein the top roller bearings are fastened to the bolt carrier at the 12 o'clock position.

10. The modular bolt-action rifle system of claim 9, wherein the top roller bearings comprise two or more roller bearings.

11. The modular bolt-action rifle system of claim 10, wherein the top roller bearings are one-half inch in diameter.

12. The modular bolt-action rifle system of claim 1, wherein the side roller bearings comprise two sets of roller bearings fastened to the bolt carrier at the 3 o'clock and 9 o'clock positions, respectively.

13. The modular bolt-action rifle system of claim 12, wherein each side of set roller bearings comprises three or more roller bearings.

14. The modular bolt-action rifle system of claim 13, wherein the side roller bearings are 10 millimeters in diameter.

15. The modular bolt-action rifle system of claim 1, wherein rifle system is chambered to fire .50 caliber, or .50 BMG, rounds.

16. The modular bolt-action rifle system of claim 15, wherein rifle system caliber can be changed from .50 caliber, or .50 BMG, to fire .416 Barrett rounds by changing only the barrel assembly.

17. The modular bolt-action rifle system of claim 16, wherein rifle system caliber can be changed from .50 caliber, or .50 BMG, to fire either .408×77 millimeter or .375×77 millimeter rounds by changing only the barrel assembly, the bolt head, and the magazine.

18. The modular bolt-action rifle system of claim 1, wherein each of the upper receiver assembly, bolt, bolt carrier group assembly, lower receiver assembly, barrel assembly, and handguard assembly contains no roll pins.

19. The modular bolt-action rifle system of claim 18, wherein the upper receiver assembly, bolt, bolt carrier group assembly, lower receiver assembly, barrel assembly, and handguard assembly of the rifle system are capable of assembly and disassembly with only the use of hex Allen keys and a small flat-head screwdriver.

20. A modular bolt-action rifle system, comprising:

an upper receiver assembly comprising a bolt and a bolt carrier group assembly;

wherein the bolt carrier group assembly comprises:

a bolt head, a bolt carrier, side roller bearings fastened to each of side of the bolt carrier;

top roller bearings fastened to the top of the bolt carrier; and a bolt charging handle, wherein the load of the bolt carrier within the upper receiver is supported by the side roller bearings, and the bolt carrier moves within the upper receiver along a longitudinal axis of the rifle guided by the side and top roller bearings and without contact by the bolt carrier with the interior of the upper receiver.

* * * * *